US008286652B2

(12) United States Patent
Gehlhoff

(10) Patent No.: US 8,286,652 B2
(45) Date of Patent: Oct. 16, 2012

(54) CONFIGURABLE ACTIVE JERK CONTROL

(75) Inventor: Wade L. Gehlhoff, Shakopee, MN (US)

(73) Assignee: Eaton Corporation, Cleveland, OH (US)

( * ) Notice: Subject to any disclaimer, the term of this patent is extended or adjusted under 35 U.S.C. 154(b) by 441 days.

(21) Appl. No.: 12/564,069

(22) Filed: Sep. 22, 2009

(65) Prior Publication Data

US 2011/0067763 A1 Mar. 24, 2011

(51) Int. Cl.
*F17D 1/20* (2006.01)

(52) U.S. Cl. ..... 137/12; 137/14; 137/486; 137/488; 60/469; 91/433

(58) Field of Classification Search ..... 137/487.5, 137/486, 488, 12, 14, 625.65; 60/469; 91/433
See application file for complete search history.

(56) References Cited

U.S. PATENT DOCUMENTS

| | | | | |
|---|---|---|---|---|
| 5,048,296 | A * | 9/1991 | Sunamura et al. | 60/468 |
| 5,230,272 | A * | 7/1993 | Schmitz | 91/361 |
| 5,261,234 | A * | 11/1993 | Holloway et al. | 60/462 |
| 5,558,115 | A * | 9/1996 | Lenz et al. | 137/86 |
| 5,857,333 | A | 1/1999 | Schmidt et al. | |
| 5,890,870 | A * | 4/1999 | Berger et al. | 414/699 |
| 6,047,228 | A * | 4/2000 | Stone et al. | 701/50 |
| 6,328,173 | B1 | 12/2001 | Wimmer | |
| 6,459,976 | B1 * | 10/2002 | Chen et al. | 701/50 |
| 6,705,079 | B1 * | 3/2004 | Tabor et al. | 60/469 |
| 6,758,233 | B2 * | 7/2004 | Sulatisky et al. | 137/14 |
| 7,007,782 | B2 * | 3/2006 | Anwar et al. | 192/70.12 |
| 7,278,262 | B2 * | 10/2007 | Moon | 60/469 |
| 7,296,404 | B2 * | 11/2007 | Pfaff | 60/327 |
| 7,383,851 | B2 * | 6/2008 | Jacobsen et al. | 137/14 |
| 7,934,377 | B2 * | 5/2011 | Kim et al. | 60/469 |
| 8,020,574 | B2 * | 9/2011 | Ohmi et al. | 137/12 |
| 2002/0104431 | A1 * | 8/2002 | Anwar et al. | 91/459 |
| 2004/0079416 | A1 * | 4/2004 | Linne et al. | 137/487.5 |
| 2006/0150809 | A1 * | 7/2006 | Shah | 91/472 |
| 2006/0248883 | A1 * | 11/2006 | Gehlhoff | 60/469 |
| 2009/0319133 | A1 * | 12/2009 | Ekvall et al. | 701/50 |
| 2010/0269632 | A1 * | 10/2010 | Dlugoss | 74/732.1 |

FOREIGN PATENT DOCUMENTS

EP 1403438 A1 3/2004

OTHER PUBLICATIONS

International Search Report and the Written Opinion of the International Searching Authority of the corresponding PCT patent application.

* cited by examiner

*Primary Examiner* — John Rivell
*Assistant Examiner* — Minh Le
(74) *Attorney, Agent, or Firm* — Quinn Law Group, PLLC

(57) ABSTRACT

A method of limiting jerk in a hydraulic system of a machine includes defining a maximum pressure rate. An output pressure of a hydraulic fluid is continuously measured over time from a work port of a hydraulic valve to determine an output pressure rate. The measured output pressure rate is compared to the maximum pressure rate. A requested flow rate is adjusted when the measured output pressure rate is greater than the maximum pressure rate to decrease the pressure differential generated in response to changing the flow rate of the hydraulic fluid through the valve, which thereby limits a change in acceleration or deceleration of the hydraulic system to limit felt jerk in the machine.

10 Claims, 2 Drawing Sheets

CONFIGURABLE ACTIVE JERK CONTROL

TECHNICAL FIELD

The subject invention generally relates to a method of limiting jerk in a machine, and more specifically to limiting jerk in a hydraulically actuated system in an off road vehicle.

BACKGROUND OF THE INVENTION

Heavy duty equipment and/or machinery, and especially heavy duty off road vehicles such as front end loaders, backhoes, excavators, bulldozers, etc., typically include hydraulic systems. The hydraulic systems utilize a hydraulic fluid to actuate hydraulic motors and/or hydraulic pistons. The flow of the hydraulic fluid to and from the hydraulic motors and/or the hydraulic pistons are generally controlled by hydraulic valves.

The hydraulic valves include a supply port that receives the hydraulic fluid from a pump, and a work port that directs the hydraulic fluid from the hydraulic valve to the hydraulic motor and/or the hydraulic piston. During operation of the hydraulic systems, an operator inputs a command, for example by actuating a control lever or the like. The inputted command actuates the hydraulic valve to abruptly move between positions to redirect the flow of the hydraulic fluid to change the movement of the hydraulic system. For example, movement of a control lever between a first position and a second position may cause the hydraulic system to raise or lower a bucket on a front end loader.

The abrupt movement between positions on heavy duty equipment generates a rapid rate of change, i.e., acceleration or deceleration, of various components on the equipment. The resultant movement of the machine caused by the rapid acceleration or deceleration of the hydraulic system is commonly referred to as jerk. When accompanied by the heavy loads that these pieces of heavy duty equipment commonly handle, excessive jerk may occur which stresses the equipment and the operator.

SUMMARY OF THE INVENTION

A method of limiting jerk in a hydraulic system of a machine is provided. The method includes continuously measuring an output pressure of a hydraulic fluid over time from a valve of the hydraulic system to determine an output pressure rate, inputting a command to adjust a flow of the hydraulic fluid through the valve from an initial flow rate to a requested flow rate, comparing the measured output pressure rate to a maximum pressure rate; and adjusting the flow of the hydraulic fluid from the initial flow rate to an allowed flow rate different than the requested flow rate when the measured output pressure rate of the hydraulic fluid is greater than the maximum pressure rate to limit jerk in the hydraulic system.

In another aspect of the invention, a method of limiting jerk in a hydraulic system of a machine is also provided. The method includes continuously measuring an output pressure of a hydraulic fluid over time from a valve of the hydraulic system to determine an output pressure rate, inputting a command to adjust a flow of the hydraulic fluid through the valve from an initial flow rate to a requested flow rate, comparing the measured output pressure rate to a maximum pressure rate; and adjusting the flow of the hydraulic fluid from the initial flow rate to an allowed flow rate different than the requested flow rate when the measured output pressure rate of the hydraulic fluid is greater than the maximum pressure rate to limit jerk in the hydraulic system. The allowed flow rate is either less than the requested flow rate to decelerate the flow rate of the hydraulic fluid from the valve relative to the requested flow rate, or greater than the requested flow rate to accelerate the flow rate of the hydraulic fluid from the valve relative to the requested flow rate.

Accordingly, the disclosed method reduces or increases the flow rate of the hydraulic fluid through the valve only when the measured output pressure rate, i.e., the rate of change of the output pressure of the hydraulic fluid, is greater than the maximum pressure rate to limit the rate of change of pressure of the hydraulic fluid, which thereby limits the acceleration or deceleration of the hydraulic system and the jerk generated in response to rapid movement of the hydraulic system. The measured output pressure rate of the hydraulic fluid from the valve corresponds to the current load on the hydraulic system. The maximum pressure rate corresponds to a maximum load on the system. Limiting the allowed flow rate to a value different from the requested flow rate only when the measured output pressure rate of the hydraulic fluid is greater than the maximum pressure rate allows the hydraulic system to operate at full speed when under light loads, and limits jerk to the machine and operator when under higher loads.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
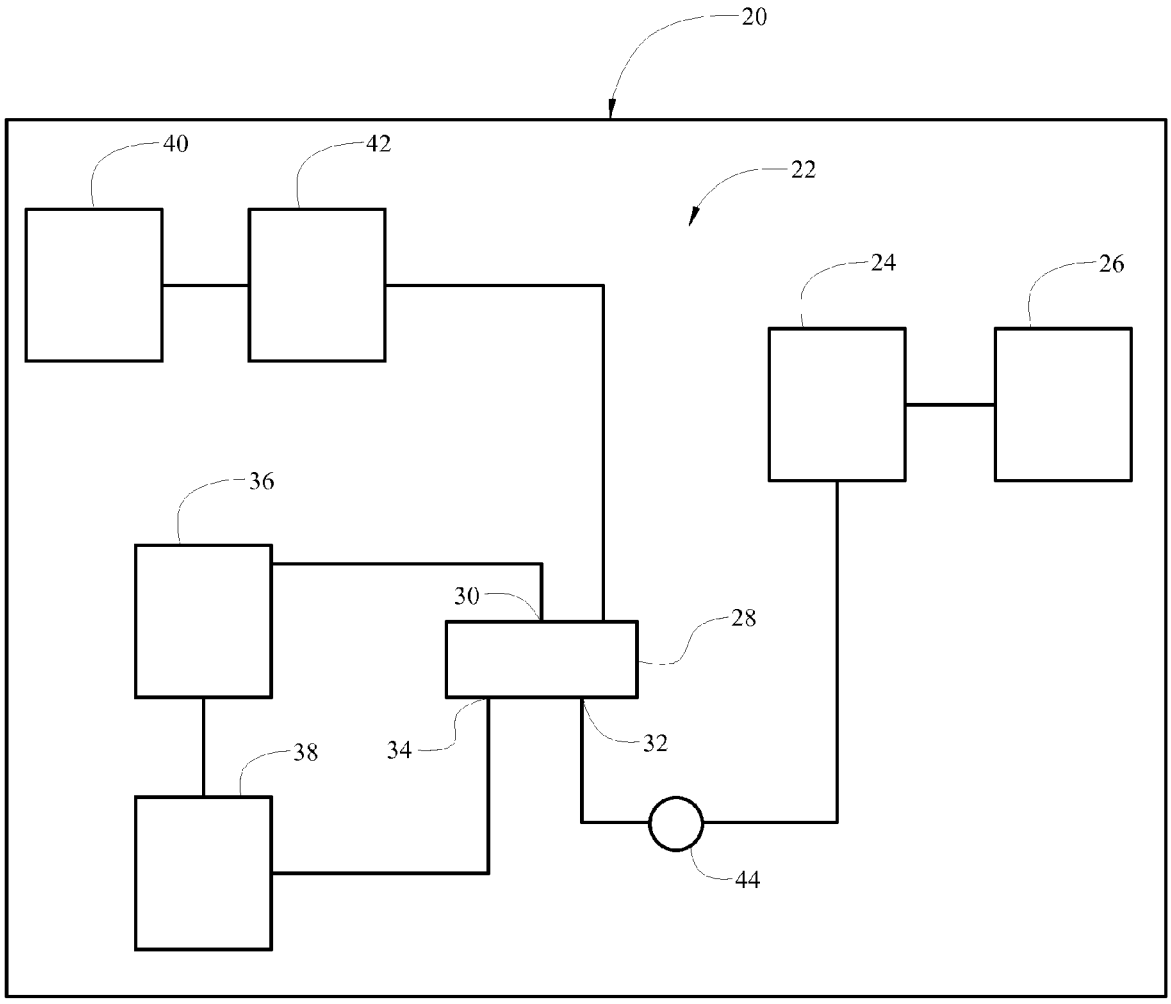
FIG. 1 is a schematic box diagram of a machine including a hydraulic system.

Referring to FIG. 1, a machine is shown generally at 20. The machine 20 may include, but is not limited to, a heavy duty off road vehicle such as a front end loader, a backhoe, an excavator, a bulldozers, etc. It should be appreciated that the machine 20 may include a machine 20 other than described herein, and may include a stationary machine 20, i.e., the machine 20 need not include a vehicle.

The machine 20 includes a hydraulic system 22. The hydraulic system 22 actuates a device 24, including but not limited to, a hydraulic piston and/or a hydraulic motor. The hydraulic system 22 is capable of rapid movement between two or more positions for moving a component 26 of the machine 20. The component 26 of the machine 20 may include, but is not limited to, a bucket of a front end loader, a boom of a backhoe or an excavator, or a blade of a bulldozer. It should be appreciated that the hydraulic system 22 may include some other device 24 other than described herein, and may also move some other component 26 other than described herein.

The hydraulic system 22 utilizes a hydraulic fluid to actuate the hydraulic device 24 as is well known in the art. The flow of the hydraulic fluid to and from the hydraulic device 24 is generally controlled by one or more hydraulic valves.

The hydraulic valve 28 may include any suitable shape and configuration of hydraulic valve 28 suitable for each specific application. Typically, the hydraulic valve 28 includes a housing that defines a bore. A spool is disposed within the bore and is moveable between at least a first position and a second position. The housing further defines a supply port 30, at least one work port 32, and at least one return port 34. Each of the supply port 30, work port 32 and the return port 34 are in fluid communication with the bore. The supply port 30 supplies the hydraulic fluid from a pump 36. The work port 32 directs the hydraulic fluid to and from the hydraulic device 24. The return port 34 returns the hydraulic fluid from the hydraulic device 24 back to a tank 38, which in turn supplies the pump 36. Movement of the spool within the bore opens and closes fluid communication between the various ports to control the flow of the hydraulic fluid through the hydraulic system 22 as is well known. While a basic hydraulic system 22 has been described herein, it should be appreciated that the hydraulic system 22 may be configured differently than described herein, and may include other various components.

During operation of the hydraulic system 22, an operator inputs a command through an input device 40. The input device 40 may include a lever coupled to a control valve, which is in fluid communication with the hydraulic valve 28. Alternatively, the input device 40 may include an electronic controller 42 configured for sending an electrical signal to the hydraulic valve 28 to control the hydraulic valve 28. The input device 40 may include some other suitable type of input and/or control device 24 suitable for controlling and operating the hydraulic valve 28.

The inputted command actuates the hydraulic valve 28 to move between positions to redirect the flow the hydraulic fluid to change the movement of the hydraulic system 22. For example, movement of a control device 24 between a first position and a second position may cause the hydraulic system 22 to raise or lower the bucket on a front end loader. When the hydraulic system 22 is under a low load, for example when a bucket of a front end loader is empty, a rapid change in acceleration of the hydraulic system 22 generates little jerk. However, when the hydraulic system 22 is under a high load, for example when a bucket of a front end loader is fully loaded, a rapid change in acceleration of the hydraulic system 22 generates significant jerk.

The machine 20 may further include a controller 42 and at least one pressure sensor 44 coupled to the hydraulic valve 28. The controller 42 may include a computer or the like, having a processor, a memory, control software and any other components necessary to operate and control the machine 20. The pressure sensor 44 is coupled to the work port 32, and configured for sensing an output pressure of the hydraulic fluid flowing between the work port 32 and the hydraulic device 24.

Figure 2:
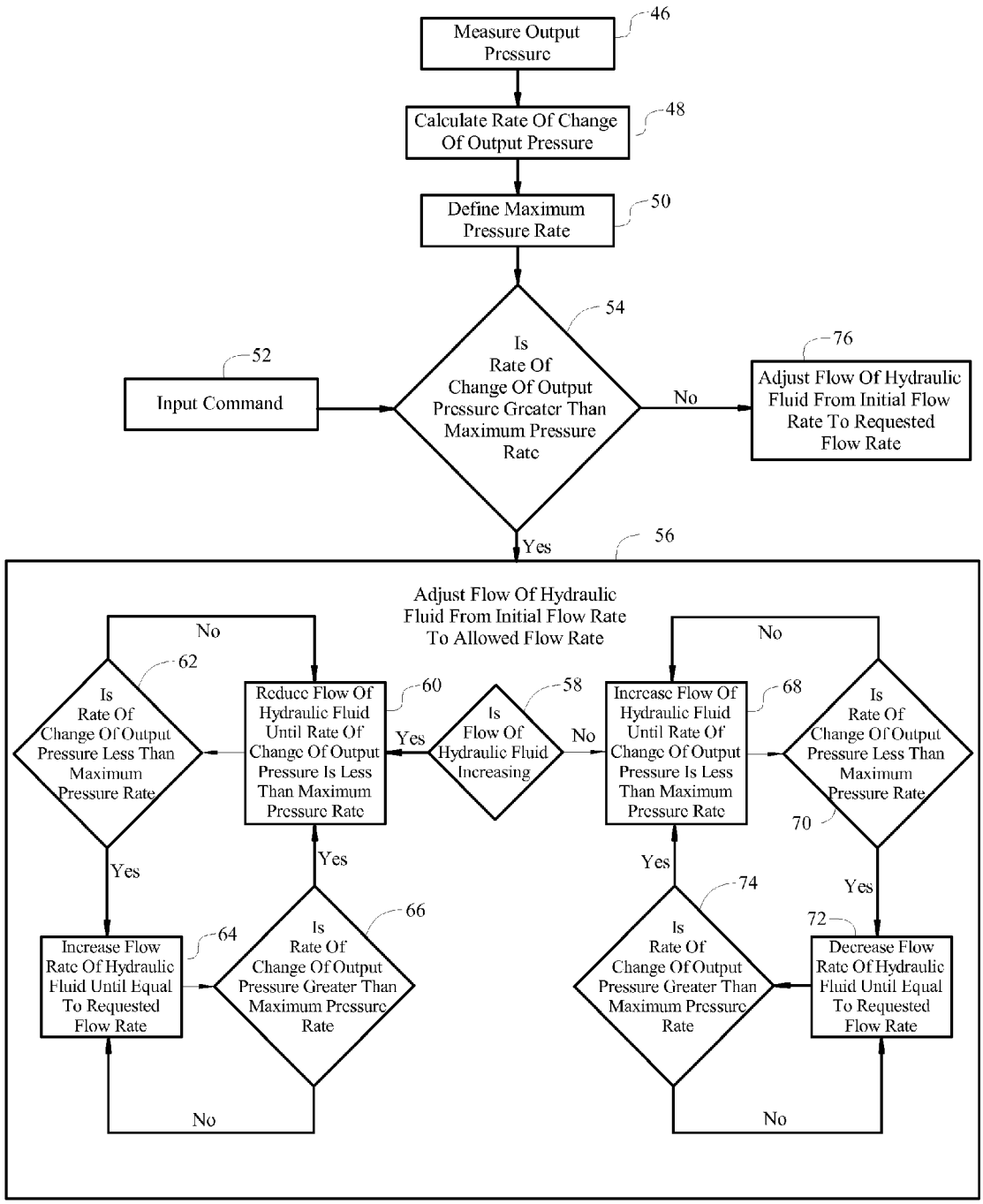
FIG. 2 is a flow chart showing a method of limiting jerk in a hydraulic system of a machine.

Referring to FIG. 2, a method of limiting jerk in the hydraulic system 22 of the machine 20 is shown. The method of limiting jerk in the hydraulic system 22 of the machine 20 includes continuously measuring the output pressure of a hydraulic fluid from the valve 28 of the hydraulic system 22 (block 46). The output pressure of the hydraulic fluid is continuously monitored to determine an output pressure rate, i.e., a rate of change of the output pressure of the hydraulic fluid from the valve 28 over time. The pressure sensor 44 measures the output pressure of the hydraulic fluid flowing from the work port 32 of the hydraulic valve 28 over time. As such, the pressure sensor 44 continuously senses the pressure of the hydraulic fluid from the work port 32 of the hydraulic valve 28. The pressure sensor 44 transmits the measured output pressure to the controller 42, which utilizes the data related to the measured output pressure in the control software as described below.

The method further includes calculating a rate of change of the output pressure of the hydraulic fluid (block 48). The rate of change of the output pressure indicates how quickly the hydraulic system 22 is accelerating or decelerating. A high rate of change of the output pressure of the hydraulic valve 28 indicates a high acceleration or deceleration, which may lead to excessive jerk. The controller 42 may calculate the rate of change of the output pressure using software, and store the rate of change of the output pressure in memory.

The method further includes defining a maximum pressure rate (block 50). The maximum pressure rate is the upper operational pressure rate of change over time of the hydraulic fluid within the hydraulic system 22. The maximum pressure rate may further be defined to include a variable maximum pressure rate, which is dependent upon an output pressure of the hydraulic fluid from the hydraulic valve 28, measured at the work port 32. Preferably, the maximum pressure rate is inversely proportional to the output pressure of the hydraulic fluid from the valve 28. As noted above, the output pressure rate at the work port 32 of the valve 28 corresponds to the load being applied to the hydraulic system 22. Accordingly, a higher output pressure rate correlates to a higher load applied to the hydraulic system 22. Similarly, a lower output pressure rate correlates to a lower load applied to the hydraulic system 22. As such, at a low output pressure rate, i.e., a low load, the maximum pressure rate is greatest. Similarly, at a high output pressure rate, i.e., a high load, the maximum pressure rate is least. The maximum pressure rate varies between a highest level associated with the lowest output pressure rate and a lowest level associated with the highest output pressure rate. The maximum pressure rate may be stored in the controller 42, for example as a table of maximum pressure rates for given output pressure rates.

The method further includes inputting a command into the hydraulic system 22 to request a change in a flow of the hydraulic fluid through the valve 28 from an initial flow rate to a requested flow rate (block 52). The requested flow rate is the desired flow rate of the fluid required to perform the given input at a given speed. As such, an input requesting a rapid change in motion of the hydraulic system 22 would require a requested flow rate of the hydraulic fluid significantly higher or lower than the initial flow rate in order to perform the inputted command. The command may be inputted by any suitable device 24 and in any suitable manner as described above.

The method further includes comparing the measured output pressure rate to the maximum pressure rate to determine which of the measured output pressure rate and the maximum pressure rate is greatest (block 54). The control software of the controller 42 compares the measured output pressure rate against the maximum pressure rate to determine if the measured output pressure rate is greater than the maximum pressure rate at the measured output pressure. If the measured output pressure rate is greater than the maximum pressure rate, then the controller 42 modifies the requested flow rate to comply with the maximum pressure rate. If the measured output pressure is less than the maximum pressure rate, then the controller 42 does not modify the requested flow rate.

Accordingly, the method includes adjusting the flow of the hydraulic fluid from the initial flow rate to the allowed flow rate, which as described above is different than the requested flow rate, when the measured output pressure rate of the hydraulic fluid is greater than the maximum pressure rate (block 56). Adjusting the flow rate limits the change in acceleration or deceleration of the hydraulic system 22, which thereby limits the jerk in the hydraulic system 22. As described above, the flow rate is adjusted by adjusting a position of the valve 28 to control the flow of the hydraulic fluid through the valve 28.

Adjusting the flow rate of the hydraulic fluid from the initial flow rate to the allowed flow rate includes determining if the change in flow of the hydraulic fluid through the valve 28 is increasing or decreasing (block 58). If the flow rate of the hydraulic fluid through the valve 28 is increasing, then the hydraulic system 22 is accelerating. If the flow rate of the hydraulic fluid through the valve 28 is decreasing, then the hydraulic system 22 is decelerating.

If it is determined that the flow rate of the hydraulic fluid is increasing, then adjusting the flow of the hydraulic fluid from the initial flow rate to the allowed flow rate may further be defined as adjusting the flow of the hydraulic fluid from the initial flow rate to an allowed flow rate that is less than the requested flow rate, i.e., the flow rate of the hydraulic fluid is reduced until the rate of change of the output pressure of the hydraulic fluid is less than the maximum pressure rate (block 60). Decreasing the flow rate decelerates the flow rate of the hydraulic fluid from the valve 28 relative to the requested flow rate, which thereby reduces the pressure of the hydraulic fluid.

The controller 42 monitors the rate of change of the output pressure of the hydraulic fluid to ensure that the rate of change of the output pressure does not rise above the maximum pressure rate (block 62). If the rate of change of the output pressure does rise above the maximum pressure rate, then the flow rate of the hydraulic fluid is further reduced. If the rate of change of the output pressure remains below the maximum pressure rate, then the flow of the hydraulic fluid is increased until the flow rate of the hydraulic fluid equals the requested flow rate (block 64). The controller 42 continues to monitor the rate of change of the output pressure against the maximum pressure rate to ensure that the rate of change of the output pressure remains below the maximum pressure rate (block 66). Accordingly, the controller 42 continues to decrease or increase the flow rate of the hydraulic fluid through the valve 28 until the hydraulic system 22 comes to equilibrium.

If it is determined that the flow rate of the hydraulic fluid through the valve 28 is decreasing, then adjusting the flow of the hydraulic fluid from the initial flow rate to the allowed flow rate may further be defined as adjusting the flow of the hydraulic fluid from the initial flow rate to an allowed flow rate that is greater than the requested flow rate, i.e., the flow rate of the hydraulic fluid through the valve 28 is increased until the rate of change of the output pressure of the hydraulic fluid is less than the maximum pressure rate (block 68). Increasing the flow rate accelerates the flow rate of the hydraulic fluid from the valve 28 relative to the requested flow rate, which thereby increases the pressure of the fluid.

The controller 42 monitors the rate of change of the output pressure to ensure that the rate of change of the output pressure does not rise above the maximum pressure rate (block 70). If the rate of change of the output pressure does rise above the maximum pressure rate, then the flow rate of the hydraulic fluid is further increased. If the rate of change of the output pressure remains below the maximum pressure rate, then the flow of the hydraulic fluid is decreased until the flow rate of the hydraulic fluid equals the requested flow rate (block 72). The controller 42 continues to monitor the rate of change of the output pressure against the maximum pressure rate to ensure that the rate of change of the output pressure remains below the maximum pressure rate (block 74). Accordingly, the controller 42 continues to increase or decrease the flow rate of the hydraulic fluid through the valve 28 until the hydraulic system 22 comes to equilibrium.

As noted above, the method further includes adjusting the flow of the hydraulic fluid from the initial flow rate to the requested flow rate when the measured output pressure rate of the hydraulic fluid is less than the maximum pressure rate (block 76). As such, when the output pressure from the work port 32 of the valve 28 is less than the maximum pressure rate, no adjustment to the requested flow rate is required. In other words, when the output pressure is less than the maximum pressure rate, the requested flow rate does not generate a significant acceleration change in the hydraulic system 22, and therefore does not generate a significant level of jerk.

While the best modes for carrying out the invention have been described in detail, those familiar with the art to which this invention relates will recognize various alternative designs and embodiments for practicing the invention within the scope of the appended claims.

The invention claimed is:

1. A method of limiting jerk in a hydraulic system of a machine, the method comprising:

continuously measuring an output pressure of a hydraulic fluid over time from a valve of the hydraulic system to determine an output pressure rate;

inputting a command to request a change in a flow of the hydraulic fluid through the valve from an initial flow rate to a requested flow rate;

defining a value for a maximum pressure rate that is dependent upon the measured output pressure of the hydraulic fluid from the valve;

comparing the determined output pressure rate to the maximum pressure rate; and adjusting the flow of the hydraulic fluid from the initial flow rate to an allowed flow rate different than the requested flow rate when the determined output pressure rate of the hydraulic fluid is greater than the maximum pressure rate to limit jerk in the hydraulic system.

2. A method as set forth in claim 1 wherein adjusting the flow of the hydraulic fluid from the initial flow rate to an allowed flow rate different than the requested flow rate is further defined as adjusting the flow of the hydraulic fluid from the initial flow rate to an allowed flow rate less than the requested flow rate to decelerate the flow rate of the hydraulic fluid from the valve relative to the requested flow rate.

3. A method as set forth in claim 1 wherein adjusting the flow of the hydraulic fluid from the initial flow rate to an allowed flow rate different than the requested flow rate is further defined as adjusting the flow of the hydraulic fluid from the initial flow rate to an allowed flow rate greater than the requested flow rate to accelerate the flow rate of the hydraulic fluid from the valve relative to the requested flow rate.

4. A method as set forth in claim 1 wherein the maximum pressure rate is inversely proportional to the output pressure of the hydraulic fluid from the valve.

5. A method as set forth in claim 1 wherein adjusting the flow of the hydraulic fluid from the initial flow rate to an allowed flow rate is further defined as adjusting a position of the valve to control the flow of the hydraulic fluid.

6. A method as set forth in claim 1 further comprising adjusting the flow of the hydraulic fluid from the initial flow rate to the requested flow rate when the measured output pressure rate of the hydraulic fluid is less than the maximum pressure rate.

7. A method as set forth in claim 1 wherein the machine includes a pressure sensor coupled to a work port of the valve and wherein continuously measuring the output pressure of the hydraulic fluid is further defined as sensing the pressure of the hydraulic fluid from the work port of the valve.

8. A method of limiting jerk in a hydraulic system of a machine, the method comprising:

continuously measuring an output pressure of a hydraulic fluid over time from a valve of the hydraulic system to determine an output pressure rate;

inputting a command to request a change in a flow of the hydraulic fluid through the valve from an initial flow rate to a requested flow rate;

defining a value for a maximum pressure rate that is dependent upon the measured output pressure of the hydraulic fluid from the valve;

comparing the determined output pressure rate to the maximum pressure rate; and adjusting the flow of the hydraulic fluid from the initial flow rate to an allowed flow rate different than the requested flow rate when the determined output pressure rate of the hydraulic fluid is greater than the maximum pressure rate to limit jerk in the machine;

wherein the allowed flow rate is either less than the requested flow rate to decelerate the flow rate of the hydraulic fluid from the valve relative to the requested flow rate or greater than the requested flow rate to accelerate the flow rate of the hydraulic fluid from the valve relative to the requested flow rate.

9. A method as set forth in claim 8 wherein the maximum pressure rate is inversely proportional to the output pressure of the hydraulic fluid from the valve.

10. A method as set forth in claim 8 further comprising adjusting the flow of the hydraulic fluid from the initial flow rate to the requested flow rate when the determined output pressure rate of the hydraulic fluid is less than the maximum pressure rate.

* * * * *